United States Patent [19]

Jacinto

[11] Patent Number: 4,592,153

[45] Date of Patent: Jun. 3, 1986

[54] HEEL CONSTRUCTION

[76] Inventor: Jose-Maria Jacinto, 429 E. 52nd St., New York, N.Y. 10022

[21] Appl. No.: 622,441

[22] Filed: Jun. 25, 1984

[51] Int. Cl.[4] ..... A43B 21/30

[52] U.S. Cl. ..... 36/38; 36/7.8; 36/27

[58] Field of Search ..... 36/38, 37, 27, 7.8, 36/83, 35 R

[56] References Cited

U.S. PATENT DOCUMENTS

| | | | |
|---|---|---|---|
| 968,020 | 8/1910 | Yandoli . | |
| 1,587,749 | 6/1926 | Bierly | 36/7.8 X |
| 1,625,048 | 4/1927 | Nock | 36/38 |
| 2,252,404 | 8/1941 | Mauser . | |
| 2,299,009 | 10/1942 | Denk . | |
| 2,387,334 | 10/1945 | Lemke . | |
| 2,441,039 | 5/1948 | Smith et al. . | |
| 2,454,951 | 11/1948 | Smith . | |
| 2,582,551 | 1/1952 | Malherbe . | |
| 2,669,038 | 2/1954 | DeWerth . | |
| 2,998,661 | 9/1961 | Israel . | |
| 3,822,490 | 7/1974 | Murawski | 36/35 R |
| 3,886,674 | 6/1975 | Pavia . | |
| 4,267,648 | 5/1981 | Weisz . | |
| 4,342,158 | 8/1982 | McMahon et al. . | |
| 4,486,964 | 12/1984 | Rudy | 36/38 X |
| 4,492,046 | 1/1985 | Kosova | 36/27 |
| 4,492,374 | 1/1985 | Lekmtman et al. | 36/7.8 X |

FOREIGN PATENT DOCUMENTS

| | | | |
|---|---|---|---|
| 1227420 | 3/1960 | France . | |
| 2407684 | 6/1979 | France | 36/37 |

OTHER PUBLICATIONS

*The Random House College Dictionary,* Revised Edition Copyright 1980, 1979, 1975 p. 128.

*Primary Examiner*—James Kee Chi

*Attorney, Agent, or Firm*—Morgan, Finnegan, Pine, Foley & Lee

[57] ABSTRACT

There is disclosed a heel construction capable of providing an optimal response for an individual wearing a shoe to which it is attached. The construction is adaptable to being permanently or detachably fixed to a shoe having an upper section and sole section which extend in a generally horizontal direction and form a toe area at one end and a heel area at the opposite end. The heel construction comprises a generally Z-shaped resilient plate the upper arm of the plate extending towards the toe area and the lower arm of the plate extending towards the periphery of the heel area of a shoe to which the construction is fixed. There may be at least one supporting shaft disposed in a transverse direction between the upper arm and the middle arm of the Z-shaped plate and at least one like shaft disposed in the same direction between the lower arm and the middle arm thereof, the shafts being located at the junctures of each of the upper and lower arms with the middle arm of the Z-shaped plate and, as well, vertically disposed springs disposed transversely betewen the arms at a distance from the junctures of the upper and lower arms with the middle arm.

21 Claims, 5 Drawing Figures

HEEL CONSTRUCTION

BACKGROUND OF THE INVENTION

This invention relates to a heel construction for use on footwear. More particularly, the invention relates to a heel construction which provides an optimal response for an individual wearing shoes provided therewith.

Although the heel construction of this invention may be used on any of a wide variety of footwear, it is particularly useful when employed on footwear utilized in the area of sports, and especially in the area of running or jogging. For the sake of simplicity, the heel construction of this invention is disclosed herein as it particularly applies to the area of running or jogging. It is to be understood, however, that it is not to be so limited and may also be used on any of a wide variety of footwear utilized for the general purposes that footwear are normally used.

In footwear technological developments, a wide variety of heel constructions are known and are readily available to the public through normal commercial channels. In general, the purposes behind such heel construction developments are multi-faceted, and among which purposes are, for example, the provision of heel constructions which enhance the aesthetic appearance of footwear to which they are attached, the provision of strong, comfortable and stable support to an individual wearing footwear to which such heel constructions are attached and, as well, the provision of a degree of springiness or bounciness which aids in alleviating foot fatigue of a user and also amplifies the physical motion of a user employing the same for walking and/or running.

An example of footwear employed for running or jogging which was developed to accomplish such purposes is disclosed in U.S. Pat. No. 4,342,158 which discloses a coned disk spring formed of a plastic material on a vertical stack of operatively coupled cone disk springs which can be embedded in a conventionally shaped heel formed of a resilient material. On the other hand, U.S. Pat. Nos. 4,267,648; 3,886,674; 2,998,661; 2,669,038; 2,454,951; 2,441,039; 2,299,009; 968,020 and French Pat. No. 1,227,420 disclose heel constructions employing a wide variety of spring arrangements generally used for shock absorbing purposes. Still further, U.S. Pat. No. 2,387,334 discloses a heel lift employing a spring for shock absorbing purposes in order to make walking more comfortable. In addition, U.S. Pat. Nos. 2,582,551 and 2,252,404 disclose detachable heel constructions having particular physical configurations.

While previous developments and designs, such as those referred to above, as well as other developments and designs of heel constructions, have enjoyed from limited to wide commercial acceptance, most of the designs developed still exhibit various drawbacks or disadvantages of one type or another. For example, among the disadvantages such designs exhibit are only a limited degree of stability, a limited degree of comfort, somewhat complex physical construction arrangements, a relatively limited useful life which results in frequent replacement and, as well, in most instances no optimal response, or at most only a limited optimal response for an individual employing the same.

There exists, therefore, a need for a heel construction which does not exhibit the above-mentioned disadvantages among others. The present invention fulfills this need.

BRIEF STATEMENT OF THE INVENTION

In accordance with the present invention, there is provided a heel construction capable of providing an optimal response for an individual wearing a shoe to which it is attached and which is adaptable to being permanently or detachably fixed to a shoe having an upper section and a sole section attached to the upper section, both of such sections extending in a generally horizontal direction and forming a toe area at one end and a heel area at the opposite end, the heel construction comprising at least one generally Z-shaped resilient plate having upper, middle and lower arms, the upper arm of the plate extending towards the toe area of a shoe to which the heel construction is fixed and the lower arm of the plate extending towards the periphery of the heel area at the opposite end of the shoe.

THE DRAWINGS

In order to understand the present invention more readily, reference is directed to the attached Drawings which are to be taken in conjunction with the following description of the invention.

Figure 1:
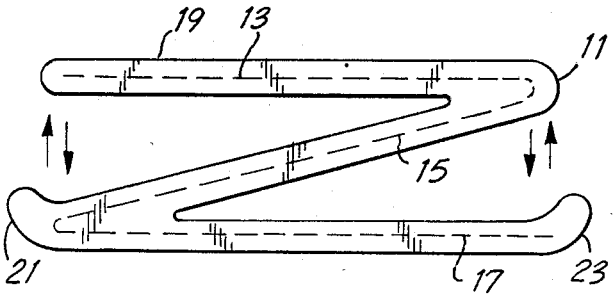
FIG. 1 is a lateral view of the heel construction according to the invention showing the Z-shaped resilient plate encased in solid rubber.
Figure 3:
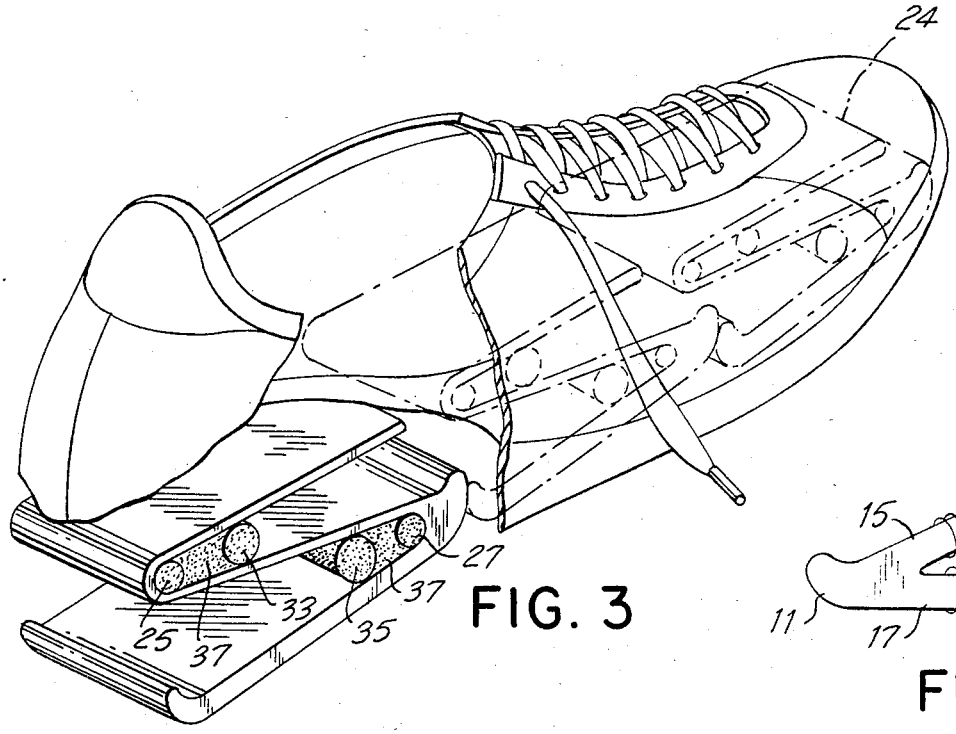
Figure 4:
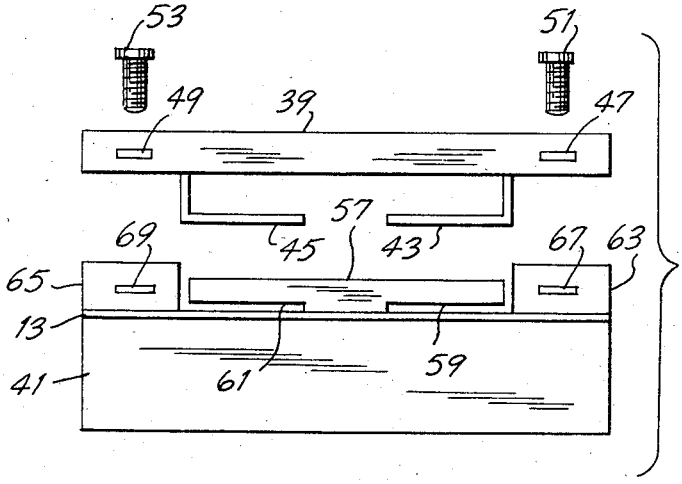

FIG. 3 is a lateral view in perspective of a variation of the heel construction illustrated in FIG. 1 attached to a shoe and in which additional solid rubber supporting shafts are employed and the vertical springs are omitted, the spaces between the shafts being filled with a soft rubber; and FIG. 4 is a schematic lateral view of the heel construction of FIG. 1 completely encased in semi-hard rubber and provided with means for detachably securing the same to the heel area of a shoe sole.

Figure 5:
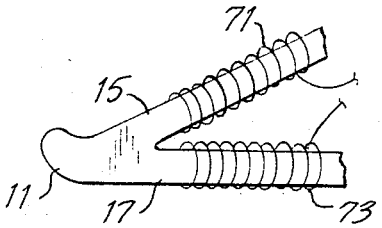

FIG. 5 is a partial lateral view of the heel construction illustrated in FIG. 1 having copper wire windings wrapped around the middle and lower arms of the construction and which windings may be energized by a remote source of energy.

DESCRIPTION OF THE PREFERRED EMBODIMENTS

Referring now more particularly to FIG. 1, a heel construction according to the invention comprises a generally Z-shaped resilient metal plate 11 having upper, middle and lower arms 13, 15 and 17, respectively and which is encased in solid rubber 19.

The leading and trailing edges 21 and 23 of the rubber encased plate 11 are curved upwardly which aids in preventing tripping or slipping and the overall dimensions of the construction are made of a sufficient width and length to properly mate with the heel area of a sole of a shoe of a particular size, thus providing good stability to a user and inhibiting swaying in a side-to-side motion, and, as well, providing a greater surface area over which the weight of a user is more evenly distributed. While the heel construction illustrated generally extends over the entire heel area of a shoe to which it is attached, it is to be understood that the arms of the Z-shaped plate may be made sufficiently long to extend up to the toe area of the shoe. On the other hand, it is within the purview of this invention to employ a plurality of such Z-shaped plates in consecutive order extending from the normal heel area of an appropriate shoe up to the toe area thereof, as shown by the dotted lines 24 in FIG. 3.

It is to be understood that in its broadest aspects, a heel construction according to this invention contemplates a construction which includes only the generally Z-shaped plate as described above, which may be attached to the sole of the heel area of a shoe having an upper section and a sole section attached thereto, both of which sections extend in a generally horizontal direction and forming a toe area at one end and a heel area at the opposite end. The construction may be fixed to the shoe in any convenient manner either permanently by fixing the construction to the shoe sole by fastening means such as rivets or the like (not shown) which pass through the shoe sole and the upper arm of the plate or by detachably fixing the construction to the shoe sole as set forth more specifically hereinafter. When in place on a shoe, the upper arm of plate 11 extends towards the toe area of the shoe and the lower arm thereof ends towards the periphery of the heel area at the opposite end of the shoe.

It will be appreciated that in accordance with the invention the generally Z-shaped plate may also be made entirely of solid rubber or synthetic materials, such as plastics having the requisite resiliency, or combinations of the same. In this respect, exemplary but not limitative examples of useful synthetic materials, are the nylons, polyurethanes, polyethylenes, polypropylenes, polyesters and the like. Insofar as rubber is concerned, either natural or synthetic rubber, such as polystyrene rubbers and the like can likewise be used to form the generally Z-shaped plate. On the other hand, the Z-shaped plate 11 is preferably made of a metal or metal alloys which are strong, light in weight, and which exhibit the requisite resiliency. Particularly preferred metals useful to form the Z-shaped plate are beryllium alloys and high-carbon steel and alloys thereof.

In accordance with this invention, supporting shafts 25 and 27, whose functions and descriptions are set forth more fully hereinafter, like plate 11, may also be made entirely of the same metals or alloys thereof, synthetic materials or rubbers, or, if desirable of suitable metals or alloys thereof encased in the same synthetic materials or rubbers and the shafts may be solid or hollow and of any suitable geometric configuration, such as circular, rectangular, square, etc. and may be fixed in their proper disposition in the plate in any convenient manner, such as by welding, adhesion, cohesion or the like, dependent upon the particular materials being used. It is generally preferred, however, that the shafts be made of solid rubber, as described hereinabove.

In addition to the advantages already mentioned above, a heel construction in accordance with this invention because of its unique configuration exhibits a bounciness. If one end of the construction is pressed downwardly, the other end moves upwardly, producing a bouncy, springy effect on a user at rest and imparting a feeling of buoyancy. This is especially so if the construction is made strong enough to totally lift up the user of a shoe to which the heel construction is attached. In addition, the heel construction of this invention cushions the impact on the heel of a user by about the same amount of force as the spring under the heel can produce. For example, if the spring produces 20 pounds of force, it can save 20 pounds of force-impact on a heel of a user. Moreover, in running or jogging, the forward thrust motion of a user is amplified by the unique design of the heel construction of this invention. The legs and feet of a runner propelling him to thrust forward will be aided by a force generated by the unique construction under the heel of a user which in accordance with its design will exert its force or thrust in the same direction as the line of force resulting from the thrust motion of the feet and legs of the user. For example, if 20 pounds of force is produced by the heel construction, it will add an additional thrust of 20 pounds on each leg of a user, or conversely, it will save 20 pounds of effort for the user.

The tension or force exerted by the heel construction varies widely and is dependent upon the thickness and resiliency of the arms of the generally Z-shaped plate 11, whether it be encased in solid rubber or utilized as a simple metallic construction only, or whether it be made entirely of rubber or one or more of the synthetic materials mentioned heretofore. The particular thickness of the construction can also be widely varied dependent upon the weight of the individual user. In this connection, it is to be understood that the thickness of the construction can be tailored to accomodate a number of individuals whose weights fall into a particular range, as well as whose shoe sizes fall within a particular range. It will be appreciated that the Z-shaped plate 11 should be made as light as possible while still exhibiting at least a degree of tension or force so that it will impart for the user an optimal response at least for a given weight, while at the same time, exhibiting excellent strength and durability in order to minimize wear on the construction per se. However, in those instances where the weight of a particular individual is so great that it has a tendency to overcome the feeling of buoyancy or bounciness normally exhibited thereby, or its ability to provide an optimal response for a user is severely diminished by a user's weight, then the embodiments of this invention, as illustrated in FIGS. 2 and 3 can be utilized in order to provide additional tension or the strength of the construction can be increased by making it of greater mass or size.

Figure 2:
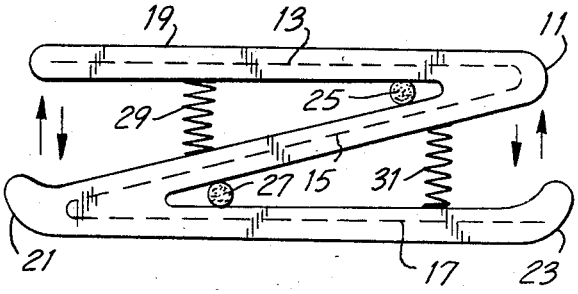
FIG. 2 is a lateral view of the heel construction illustrated in FIG. 1 in which supporting shafts are disposed between the upper and middle arms and the lower and middle arms of the Z-shaped plate, as well as vertically disposed springs.

Considering more particularly FIG. 2, it is to be noted that the embodiment of the heel construction in accordance with this invention as illustrated there is provided with solid rubber supporting shafts 25 and 27 disposed between the upper arm and the middle arm and between the lower arm and the middle arm of plate 11 at the junctures of each of the upper and lower arms with the middle arm. Shafts 25 and 27 may simply be set in their respective positions between the arms, but are preferably fixed therein in a conveniently suitable manner, such as by adhesion or the like. In addition, at least one vertical spring 29 may be disposed between the upper arm and the middle arm and at least one vertical spring 31 disposed between the lower arm and the middle arm of the Z-shaped plate 11 at a distance from the junctures of each of the upper and lower arms with the middle arm. These springs are chosen so that the requisite amount of tension can be added to accomodate additional weight. For example, a spring may be selected to add up to 50 pounds or more of tension to the construction. Moreover, if desirable, a plurality of such springs (not shown) may be disposed transversely across the Z-shaped plate 11 in order to increase the tension as needed for an individual of a particular weight. Conversely, in a situation where more tension is needed and the springs are not present, then the Z-shaped construction is made heavier in order to accomodate the weight of a particular user. In such instances, however, as the thickness or massiveness of the Z-shaped plate is increased, a loss of flexibility generally results. The optimum thickness or massiveness of the Z-shaped structure which will still exhibit the degree of flexibility needed in order to provide a feeling of buoyancy and optimal response for a given individual is readily determinable by calculation and testing. While the embodiment of the heel construction of this invention shown in FIG. 2 includes springs 29 and 31, it is preferred that the construction employs the shafts only.

It will be appreciated, that in accordance with the invention, shafts 25 and 27 also act to strengthen tension and as well provide a longer useful life to the Z-shaped structure. In this connection, tension of the Z-shaped plate is strengthened for each shaft employed, and where two shafts are employed, tension is increased by at least more than 100%. Now, in addition to strengthening tension, the shafts 25 and 27 also protect the Z-shaped plate from excessive wear and tear imparting essentially indefinite longevity to the rubber encased metallic plate or where the Z-shaped plate is made entirely of rubber or a suitable substitute synthetic material. In addition, the utilization of the shafts increases the longevity of a Z-shaped plate by at least about 100 times or more. Consequently, even though a heel construction in accordance with this invention, might be made without employing the supporting shafts 25 and 27 only, the useful life thereof is somewhat impaired.

As may be seen from FIG. 3, illustrating another embodiment of the heel construction of this invention, springs 29 and 31 are eliminated and in their places additional solid rubber supporting shafts 33 and 35 will impart the same increased tension to the construction. In this embodiment, however, there may also be employed a soft resilient material 37 to fill the spaces between shafts 25 and 33 and 27 and 35, respectively. The presence of such material which may be a suitable plastic or synthetic material or a rubbery material such as those mentioned above, which may be employed to encase a Z-shaped metallic plate, or if the material is the same as that employed to form a Z-shaped plate, aid in producing the sensation of buoyancy, as well as aiding in the provision of an optimal response for an individual user. The material so employed can be simply disposed in the spaces between the shafts or may be fixed therein by adhesion, cohesion and the like or in any other suitable manner.

While a heel construction in accordance with this invention may be employed in any of the fundamental embodiments thereof, as set forth in detail heretofore, it is generally preferred that the construction be completely enclosed, or encased completely, by a normally heel-shaped enclosure. Such an enclosure greatly enhances the aesthetic appearance of a shoe in which the heel construction of this invention is employed. Moreover, the enclosure may be permanently or detachably fixed to a shoe in any convenient manner.

On the other hand, one aspect of the instant invention is an arrangement or means for detachably fixing the heel construction of this invention to a shoe as i11ustrated in FIG. 4.

As may be seen from FIG. 4, means for detachably fixing a heel construction according to this invention to a shoe include a generally heel-shaped top member or plate 39 which is a permanent part of the heel assembly and a mating generally heel-shaped bottom member or plate 41. Top member or plate 39 is provided with transversely disposed downwardly extending L-shaped brackets 43 and 45 and openings 47 and 49 through which locking bolts or screws 51 and 53 are inserted. On the other hand, bottom member or plate 41 is provided with a centrally located pocket (not shown) into which a heel construction of this invention, generally referred to by numeral 13, is inserted. The upper arm of the Z-shaped plate of the heel construction has fixed thereto in any appropriate manner, dependent upon the material from which the construction is made, a member 57 which is undercut or notched transversely to mate with L-shaped brackets 43 and 45, as shown at 59 and 61. The upper portions 63 and 65 of plate 41 are provided with openings 67 and 69 which are disposed to be in alignment with the openings 47 and 49 of plate 39. Although only two openings are shown in each plate, it is to be understood that like openings are located on the other side of the plate.

To fix the assembly to an appropriate shoe, the bottom plate 41 is mated with the top plate 39 by sliding the plates together so that the brackets 43 and 45 are disposed in the undercut or notched areas 59 and 67 of the undercut or notched member 57 fixed to upper arm 13 of the Z-shaped plate of the heel construction. Subsequently, the assembled plates are disposed on the heel area of an appropriate shoe and locking bolts or screws 51 and 53 of sufficient length are passed through conveniently located openings in the sole of the heel area of the shoe, the openings 47 and 49 of the top plate 39 and openings 67 and 69 of bottom plate 41 and locked in place, thus providing an assembly which is securely fixed in place on the shoe but which may be conveniently removed, when desired.

Plates 39 and 41 and their associated elements may be made of rubber or plastics of varying degrees of hardness or softness, such as those plastics and rubbers mentioned above. Generally, however, brackets 43 and 45 are preferably made of metal or plastic or rubber coated metal and the locking bolts or screws are generally made of metal, hard rubber or plastic.

Moreover, while the particularly described detachable assembly is a preferred arrangement for accomplishing the instant invention, it is to be understood that the assembly can be appropriately designed so that the plates 39 and 41 can be attached to each other from the back or the front, that is from the trailing edges or the leading edges of the plates, rather than in a transverse direction, as illustrated. Such modifications require only the orientation of the brackets 45 and 47 and the undercut or notched areas of the member 57 fixed to the upper arm of the generally Z-shaped plate in an appropriate generally horizontal direction.

It is also to be understood that it is within the purview of this invention that the generally Z-shaped plate may be made of an appropriate metal which is magnetized, or if the plate is made of metal encased in which rubber or plastic, or even made entirely of rubber or plastic, magnetic particles may be distributed in those materials. Thus, magnetic properties may be imparted to the construction. In accordance with this aspect of the invention, footwear to which such a modified heel construction is attached is particularly useful in the area of space technology. For example, such a construction due to its magnetic properties permits a user to be immobilized against a wall, the top or the floor of a space vehicle. At the same time, becuase of the flexibility of the Z-shaped plate, a user is able to overcome the magnetic attraction of the heel construction and easily propel himself with greater accuracy to any other given area of the space vehicle with a minimum of force in the weightless conditions encountered in space. Still further in the area of space technology, a heel construction, in accordance with this invention, due to the flexibility of the Z-shaped construction, can be advantageously employed to traverse the surface areas of a heavenly body such as, for example, the surface of the moon, where the force of gravity is less than that of the earth, by even greater distances than can be covered with footwear which does not employ the construction. Still further, in the area of space technology, a heel construction in accordance with this invention can be appropriately modified so that an appropriate electric charge, either positive or negative, can be applied thereto. In accordance with this aspect of the invention, the middle and lower arms 15 and 17 of the generally Z-shaped plate can be partially wrapped with windings 71 and 73, which may be made of, for example, copper wire, as shown in FIG. 5, the windings being attached to a remote source of power (not shown). Upon energization of the windings, a user could be attracted to or propelled away from a given point or area of a space vehicle which had an appropriate opposite or like charge.

It is to be further understood that a heel construction in accordance with this invention may also be incorporated in ski boots. When the construction is so employed, a user of boots so equipped not only has the same advantages flowing from the construction as when the construction is employed in footwear used for general purposes or for running or jogging, but also the additional advantage of aiding a skier to increase his distance when jumping.

Still further, it is within the purview of this invention that a heel construction in accordance therewith may be modified by making the dimensions of the lower arm 17 of the Z-shaped plate of greater width and horizontal dimensions that the upper arm 13 and middle arm 15, thus providing a platform-like arrangement (not shown) of desired size. In use such an arrangement when attached to an appropriate shoe may be employed to serve as a snowshoe for traversing the surfaces of heavily snow covered terrain or traversing terrain covered with thick layers of dust or mud and the like. Numerous other uses and advantages of a heel construction according to this invention will be apparent to those skilled in the art.

The heel construction of this invention is not only advantageous for the reasons and wide areas of use set forth above, but also because of the fact that it may be made from a wide variety of materials which are readily available through normal commercial channels. In addition, because of its relatively simple design, manufacture of the heel construction of this invention can be accomplished in a relatively straight forward means without the need for development of complex machinery and manufacturing techniques.

It is to be understood that this invention in its broadest aspects is not limited to the specific embodiments herein shown and described but departures may be made therefrom within the scope of the appended claims without departing from the principles of the invention and without sacrificing its chief advantages.

What is claimed is:

1. A heel construction capable of providing an optimal response for an individual wearing a shoe to which it is attached and adaptable to being permanently or detachably fixed to a shoe having an upper section and a sole section attached to said upper section, both of said sections extending in a generally horizontal direction and forming a toe area at one end and a heel area at the opposite end, the heel construction comprising at least one generally Z-shaped resilient plate having upper, middle and lower arms, the upper arm of said plate extending towards the toe area of a shoe to which said heel construction is fixed, the lower arm of said plate extending towards the periphery of the heel area at the opposite end of said shoe and at least one supporting shaft disposed in a transverse direction between the upper arm and the middle arm and at least one supporting shaft disposed in a transverse direction between the lower arm and the middle arm of the Z-shaped plate at the junctures of said upper and lower arms with said middle arm.

2. A heel construction according to claim 1 wherein the Z-shaped resilient plate is made of metal.

3. A heel construction according to claim 1 wherein the Z-shaped resilient plate is made of beryllium.

4. A heel construction according to claim 1 wherein the Z-shaped resilient plate is made of high-carbon steel.

5. A heel construction according to claim 1 wherein the Z-shaped resilient plate is made of plastic.

6. A heel construction according to claim 1 wherein the Z-shaped resilient plate is made of solid rubber.

7. A heel construction according to claim 1 wherein the Z-shaped resilient plate is made of metal encased in solid rubber.

8. A heel construction according to claim 1 wherein the Z-shaped resilient plate is made of metal encased in plastic.

9. A heel construction according to claim 1 wherein the supporting shafts are made of metal.

10. A heel construction according to claim 1 wherein the supporting shafts are made of beryllium.

11. A heel construction according to claim 1 wherein the supporting shafts are made of high-carbon steel.

12. A heel construction according to claim 1 wherein the supporting shafts are made of plastic.

13. A heel construction according to claim 1 wherein the supporting shafts are made of solid rubber.

14. A heel construction according to claim 1 wherein the supporting shafts are made of metal encased in solid rubber.

15. A heel construction according to claim 1 wherein the supporting shafts are made of metal encased in plastic.

16. A heel construction according to claim 1 wherein the leading and trailing edges of the lower arms of the Z-shaped plate are curved upwardly.

17. A heel construction according to claim 1 including at least one vertical spring disposed between the upper arm and the middle arm and at least one vertical spring disposed between the lower arm and the middle arm of the Z-shaped plate at a distance from the junctures of each of said upper and lower arms with said middle arm.

18. A heel construction according to claim 1 including a plurality of vertical springs disposed transversely between the upper arm and the middle arm and a plurality of vertical springs disposed transversely between the lower arm and the middle arm of the Z-shaped plate at a distance from the junctures of each of said upper and lower arms with said middle arm.

19. A heel construction according to claim 1 including at least one additional supporting shaft disposed in a transverse direction between the upper arm and the middle arm and at least one additional supporting shaft disposed in a transverse direction between the lower arm and the middle arm of the Z-shaped plate, said additional shafts being spaced apart from the shafts disposed at the junctures of each of the upper and lower arms with said middle arm and the spaces between the shafts located between said upper arm and said middle arm and said lower arm and said middle arm having soft resilient material disposed therein.

20. A heel construction according to claim 1 including means for detachably fixing said construction to a shoe.

21. A heel construction according to claim 1 including means for permanently fixing said construction to a shoe.

* * * * *